United States Patent [19]

Becker et al.

[11] 4,005,824

[45] Feb. 1, 1977

[54] SPRAY GUN QUICKLY CONVERTIBLE BETWEEN AIR AND AIRLESS OPERATING MODES

[75] Inventors: Robert D. Becker, Arcadia; Freddie S. Kaderka, Covina, both of Calif.

[73] Assignee: Grover Smith Mfg. Co., Montebello, Calif.

[22] Filed: Aug. 21, 1975

[21] Appl. No.: 606,653

[52] U.S. Cl. ..... 239/289; 239/415; 239/528; 239/600

[51] Int. Cl.[2] ..... B05B 15/10

[58] Field of Search ..... 239/289, 390, 415, 414, 239/424, 526, 527, 528, 600

[56] References Cited

UNITED STATES PATENTS

| | | | |
|---|---|---|---|
| 1,797,209 | 3/1931 | Bramsen et al. | 239/528 X |
| 2,970,773 | 2/1961 | Keryluk et al. | 239/414 X |
| 3,093,311 | 6/1963 | Morris et al. | 239/414 X |
| 3,202,363 | 8/1965 | Kautz et al. | 239/412 X |
| 3,690,556 | 9/1972 | McCain | 239/412 X |
| 3,799,453 | 3/1974 | Hart | 239/600 |
| 3,886,958 | 6/1975 | Diebel et al. | 239/600 X |

*Primary Examiner*—Evon C. Blunk
*Assistant Examiner*—Michael Mar
*Attorney, Agent, or Firm*—Sellers and Brace

[57] ABSTRACT

A spray gun quickly convertible between an airless non-fogging mode and a fogging or air mode when using a fog dispensing wand accessory. The hand grip is formed in part by a valve housing for the liquid component and, in part, by the overlapping ends of a pair of valve control levers for the gun. The fog generating chamber embraces the spray nozzle of the spray gun, and is formed within the coupling holding the fog dispensing wand detachably assembled over the spray nozzle.

18 Claims, 3 Drawing Figures

SPRAY GUN QUICKLY CONVERTIBLE BETWEEN AIR AND AIRLESS OPERATING MODES

This invention relates to hand-held spray guns, and more particularly to a simply-constructed easily-controlled spray gun which is quickly convertible between an airless non-fogging mode and a fog producing air mode.

Many proposals have been made heretofore for hand-held spray guns by which either liquids alone or liquids mixed with pressurized air can be dispersed in finely divided form. However, these guns cannot be used selectively to spray liquid and to convert the liquid spray into fog by jetting pressurized air into the spray in a fog generating chamber. Exceptions to this general characterization of the prior art are the convertible spray guns proposed in the patent to Fridell U.S. Pat. No. 2,804,343; Kautz U.S. Pat. No. 3,208,673 and Kautz et al. U.S. Pat. No. 3,202,363. Each of these spray guns is provided with a fogging accessory comprising a long, hollow wand one end of which is clampable over the spray charge nozzle and utilizes pressurized air mixed with the pressurized liquid spray to convert the latter into a fog which is dispensed from the outer end of the wand. However, each of these prior convertible spray guns utilizes pressurized liquid in a piston chamber to open the air admission valve. Such guns are subject to the distinct disadvantage that they inherently discharge liquid alone from the spray nozzle initially. This liquid cannot be atomized and collects in the fogging chamber and in the fog distributing wand. It is at once apparent that the pressurized air cannot be utilized to purge the spray gun of this residue non-atomized liquid. Another serious disadvantage of prior convertible spray gun constructions is the lack of proper facilities for converting them quickly and substantially instantly from fogging operation to the airless liquid spraying mode.

The foregoing and other shortcomings of prior spray guns, particularly of the convertible type, are avoided by the present invention which provides a spray gun selectively operable in either the air or fogging mode and in the airless or non-fogging mode. The new gun is substantially instantly convertible from one to the other mode without need for tools and simply by snapping on or snapping off the specially constructed fog generating and dispensing wand accessory. The snap-on coupling for the wand accessory includes a fluid seal which assures a fluid-tight connection as an incident to snapping the wand accessory onto or about the spray nozzle. The liquid flow control valve is operated by a lever forming a part of the gun hand grip and the operation of this control lever is utilized to operate and open the air flow control valve in advance of the liquid control valve.

Another feature of the invention is the fact that both the liquid and air flow control valves are completely isolated from one another as respects the flow of fluids therepast with the result that the fluid cannot come in contact with any portion of the air valve to contaminate it or interfere with its operation. Likewise, each fluid is confined to its own flow path and these fluids merge with one another only in the fog generating chamber surrounding the discharge end of the fluid nozzle.

Accordingly, it is a primary object of the present invention to provide an improved simply and inexpensively constructed spray nozzle which is quickly convertible between air and airless operating modes.

Another object of the invention is the provision of a hand-held spray gun which can be used to spray liquid alone or quickly converted to a fog generating mode by snapping a fogging accessory over its spray discharge nozzle.

Another object of the invention is the provision of a lightweight, simply constructed spray gun having a hand grip formed in part by the main body of the nozzle and in part by overlapping portions of the operating levers for the liquid and air flow control valves.

Another object of the invention is the provision of a hand-held spray gun quickly convertible to a fog generating and dispersing device by snapping a fogging accessory over the discharge end of the spray nozzle and opening the air control valve.

Another object of the invention is the provision of a spray gun quickly convertible between fogging and non-fogging operating modes and having an air flow control valve operable independently of the liquid flow control valve with means for assuring operation of the air valve prior to the liquid valve thereby permitting the air valve to be used to purge portions of the gun of residual liquid.

These and other more specific objects will appear upon reading the following specification and claims and upon considering in connection therewith the attached drawing to which they relate.

Referring now to the drawing in which a preferred embodiment of the invention is illustrated:

Figure 1:
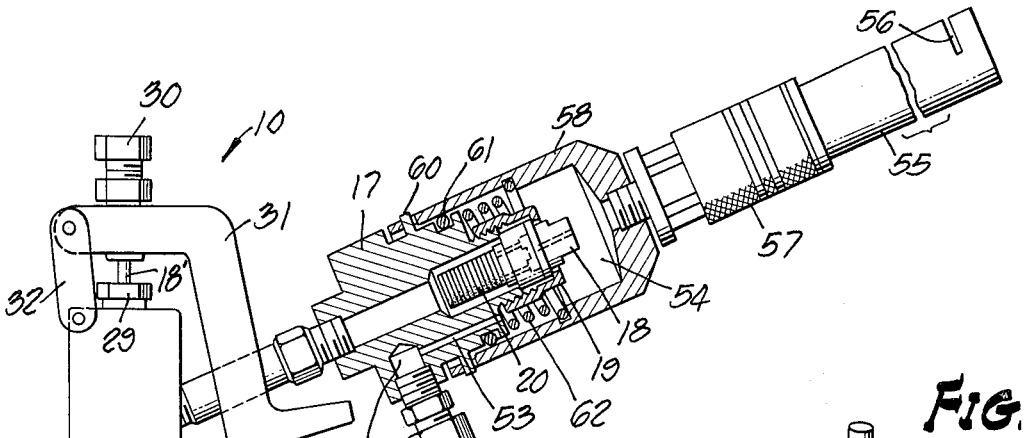
FIG. 1 is a perspective view of the convertible spray gun with a fogging accessory attached thereto and showing the pressurized hoses connected in circuit with a liquid pump and a storage drum of liquid.

Referring initially more particularly to FIG. 1, there is shown an illustrative embodiment of the invention convertible spray gun, designated generally 10, connected to a pressurized liquid supply hose 12 and to a pressurized air supply hose 11. As here shown, hose 12 is supplied with pressurized liquid by an air-operated fluid pump 15 connected in known manner to a container 16 charged with the liquid to be dispensed by gun 10. The liquid pressurizing pump 15 may be of any suitable type such as that disclosed in U.S. Pat. No. 3,019,773 granted to Wm. M. Meeker. This pump is energized by pressurized air from any suitable source and supplied thereto by hose 11.

Figure 2:
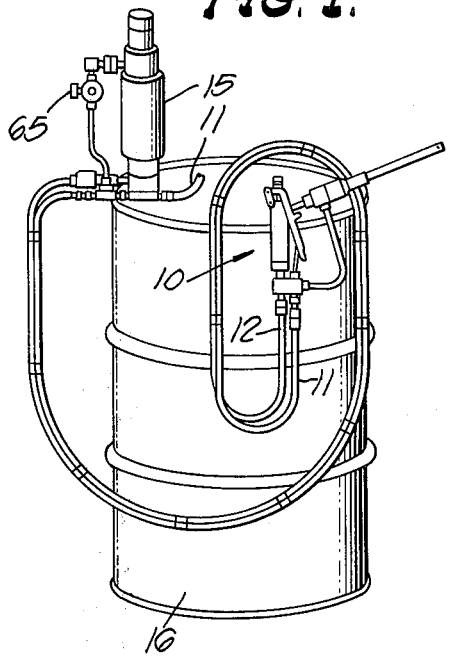
FIG. 2 is a view of the spray gun per se on an enlarged scale with portions broken away to show constructional details.
Figure 2:
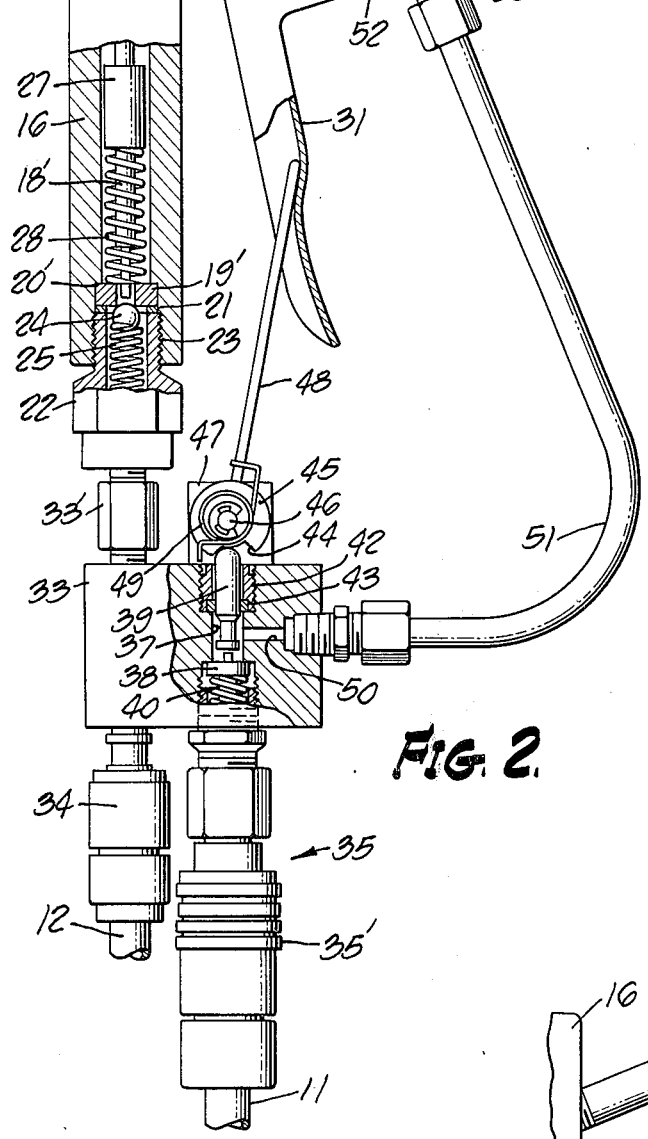

Referring now more particularly to FIG. 2, the convertible spray gun 10 will be understood as having an inverted generally L-shaped main body including an upright leg 16 and a laterally extending leg 17 at the outer end of which the spray dispensing nozzle 18 of conventional construction is securely mounted by assembly nut 19. The spray nozzle assembly 18 includes a conventional filter 20 through which liquid entering the nozzle must pass to prevent clogging of the spray nozzle ports by foreign matter.

The hollow main body 16 houses the liquid control valve having an operating plunger 18' reciprocally supported axially thereof. The inner end of plunger 18' is provided with axial flutes which extend loosely through a packing gasket 21 held pressed against a shoulder 20' by the valve seat ring 19' and bushing 22 mating with the threads 23 of the main body. A ball valve 24 is normally held seated against the seat of ring 19' by a compression spring 25.

Plunger 18' is provided with a collar 27 against which the upper end of the compression spring 28 bears whereas its lower end bears against seat 19'. Normally the spring holds the valve plunger 18 in its upwardly extended position with the lower end spaced very substantially from ball valve 24. The upper end of plunger 18' extends outwardly through a packing gland 29 mounted in the upper end of the main body and into contact with the adjustable stop screw 30 having its threads mating with threads in the valve operating lever 31. This lever is pivotally connected to the upper end of the main body by a pair of links 32. The laterally extending leg 17 of the main body projects through an elongated opening in the midportion of the operating lever 31 and provides a stabilizing guide for the operating lever.

The lower end of main body 16 is connected to a valve housing 33 by a tubular coupling 33'. This housing has a pair of parallel bores one of which is in alignment with and connectable to the liquid supply hose 12 and the other of which is in alignment with and connectable to the pressurized air hose 11 by a snap-action air control valve 35. Each of these hoses are preferably connected to the respective flow passages in housing 33 by swivel coupling 34 and air control valve 35. Only the air flow passage 37 is shown in housing 33 since this passage houses the air flow regulating valve 38 and the actuating plunger 39 therefor.

Valve 38 is normally urged closed by compression spring 40, the actuating plunger 39 for the valve being reciprocably supported in threaded bushing 42 embraced at its base by an O-ring seal 43. The rounded upper end of plunger 39 extends into a notch 44 formed in the rim of an operating cam 45 mounted on a pivot pin 46 supported between a pair of brackets 47 forming part of the valve housing 33. Projecting upwardly and radially from cam 45 is an operating lever 48 which is normally biased to rotate clockwise by a torsion spring 49. This spring rotates cam 45 and its operating lever 48 to the right and against the interior of the liquid valve operating lever 31.

The upper or outlet side of the air valve 38 is connected by a passage 50 and duct 51 to the laterally extending leg 17 of the air gun. The air flows into a distributing channel 52 partially embracing the interior of leg 17 from which it is dispersed through three axially extending distributing passages 53 into the fog generating chamber 54 embracing the outer end of spray nozzle 18.

The fogging accessory comprises a long tubular wand 55 which may be closed or open at its outer end and provided with one or more fog outlet ports 56 usually but not necessarily opening through its sidewall. Such outlets may be of various shapes and sizes well known to persons skilled in this art and in and of themselves constitute no part of this invention. The base end of the tubular wand 55 is connected by a fast action coupling 57, such as a ball type coupling, to a second fast action cup-shaped coupling 58. Coupling 57 permits wands of different lengths, contours and having differently arranged outlet ports to be substituted, one for the other, without need for disconnecting coupling 58 from the spray gun. The snap-on coupling 58 has a loose telescopic fit over the spray nozzle end of the gun body 17 and is here shown provided with bayonet type coupling 60 to hold it detachably coupled to main body member 17.

A fluid-tight junction between main body 17 and coupling 58 is provided by an O-ring 61 mounted in a groove encircling the main body. A helical type compression spring 62 has its larger end held captively assembled in a groove in the interior sidewall of coupling 58, its opposite end being sized to bear resiliently against the end of the main body 17 and cooperating with the bayonet coupling to hold the accessory firmly but detachably assembled to the spray gun.

The operation of the convertible spray gun 10 will be readily apparent from the foregoing detailed description of its components and their operative relationship to one another. To place the equipment in operation the operator supplies pressurized air to hose 11 and opens a control valve 65 on pump 15 (FIG. 1) to supply pressurized air to the upper end of the air powered motor 15. This motor then operates in known manner to supply pressurized liquid from container 16 to the spray gun via hose 12. Normally, the liquid flow control valve 24 is closed and so is the air flow valve 38.

Figure 3:
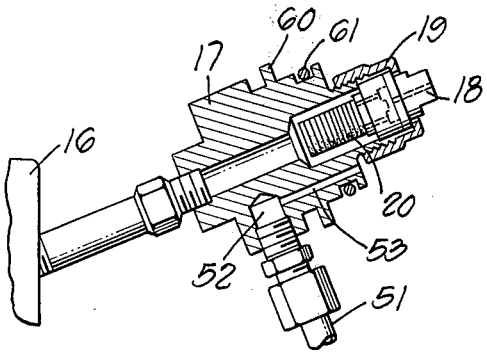
FIG. 3 is a fragmentary view of the discharge end of the spray gun with the fogging accessory detached therefrom.

If the gun is to be operated in the airless mode, the fogging accessory is detached simply by uncoupling the snap-action coupling 58 from leg 17 of the main body. The spraying end of the gun then has the appearance shown in FIG. 3. The operator also shifts the sleeve 35' of the sliding air valve 35 to its alternate position cutting off the supply of pressurized air to the spray gun. This having been done, the operator grasps the upright leg 16 of the main body with his fingers in contact with the operating lever 31 and squeezes this lever thereby opening the liquid flow control valve 24. The pressurized liquid then flows upwardly through the main body, through lateral leg 17, into filter 20 and thence through nozzle 18 from which it issues in a finely dispersed spray.

The spray gun may be used to spray objects of all kinds and is particularly useful to spray protective coatings on vehicle bodies, and particularly the interior and under surfaces thereof to safeguard the same against road chemicals, salt water and the like. In performing these operations it is frequently desirable to disperse the protective coating into the interiors of door structures and the like places of intricate configuration which are extremely difficult to reach and coat uniformly with liquid spray issuing from nozzle 18. These and the like areas are easily and quickly reached simply by snapping the fogging accessory 55, 58 over the spray nozzle and shifting the sliding valve 35' to its alternate position to supply pressurized air to the fog generating chamber 54. These conversion operations are accomplished in a matter of seconds by simply telescoping coupling 58 over the spray nozzle and snapping the bayonet coupling 60 closed. Thereafter the operator operates the spray gun in the same manner discussed above. In doing so, depression of valve lever 31 a short distance operates to rotate air valve lever 48 counterclockwise thereby opening the air valve in advance of the liquid valve 24. Full or substantially full air flow occurs without opening liquid valve 24. As the operator holds the control levers in this position, air flows through duct 51 and through the distributing passages 53 in main body leg 17. This air issues about the exterior of the spray nozzle 18. Normally no liquid coating material will then be present in the fogging accessory but should any liquid or foreign material be present it will be purged and discharged from the gun and the fogging accessory by the flow of pressurized air.

Further squeezing of the operating lever 31 then opens the ball valve 24 permitting the liquid spray to emerge into and across the flow of pressurized air already taking place in fogging chamber 54. This fast flowing pressurized air quickly atomizes and converts the liquid spray into fog which is then dispensed along the interior of the wand and outwardly through its discharge aperture 56. This extremely fine fog then settles onto the surfaces to be coated.

At the end of the fogging operation, the operator can release the control levers 31, 48 slowly until the liquid valve 24 closes thereby leaving the air valve open so that the flow of pressurized air then thoroughly flushes any remaining fog and liquid residue present in the fogging accessory outwardly from aperture 56. Thereafter the air valve is allowed to close, the fogging accessory is snapped from its assembled position and the sliding air valve 35' is closed thereby restoring the spray gun to airless mode of operation.

While the particular spray gun quickly convertible between air and airless operating modes herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

We claim:

1. A liquid spray gun quickly convertible for use selectively in an air mode with a spray distributing wand and in an airless non-fogging mode, said spray gun comprising: a hollow main body having separate valve-controlled pressurized liquid and pressurized air passages, valveless spray nozzle means fixedly supported at the discharge end of said liquid passage and having a housing which is exposed and accessible for inspection when said gun is being used in said airless mode, a fogging wand accessory comprising a long tubular fog distributing wand having a tubular coupling at the inlet end thereof adapted to be telescoped over and embracing said spray nozzle means and cooperating therewith to form a fogging chamber for liquid discharging from said nozzle means, means for supplying pressurized air from said pressurized air passage into said fogging chamber and into liquid spray issuing from said nozzle means in a manner to convert said liquid spray into a fog for flow through and discharge from said wand, means for deactivating the supply of air about said nozzle means when said wand accessory is detached therefrom, and manually regulatable means for operating said valve controlled liquid and air passages to supply properly proportioned pressurized liquid to said nozzle and pressurized air to said fogging chamber when said fogging wand accessory is assembled over said nozzle means.

2. A convertible spray gun as defined in claim 1 characterized in that said fogging wand accessory is provided at the inlet end thereof with a deep cup-shaped coupling adapted to be telescoped over said spray nozzle means and having quickly detachable connector means for holding the same telescoped about said spray nozzle means, and seal means forming a fluidtight seal between said spray gun and said cup-shaped coupling when said wand accessory is attached thereto.

3. A convertible spray gun as defined in claim 1 characterized in that said hollow main body is generally of inverted L-shape with one leg projecting laterally from the upper end of the upright leg, said spray nozzle means being mounted in the outer end of said laterally projecting leg, separate coupling means at the lower end of said upright leg for connecting a pressurized liquid hose to one of said coupling means and a pressurized air hose to the other one thereof, and said manually actuable means for said valve controlled passages comprising a pair of levers extending along and beside said upright leg with their free ends in engagement with one another when actuated, and said levers cooperating with said upright leg in forming a hand grip for said spray gun.

4. A convertible spray gun as defined in claim 3 characterized in that said liquid flow control valve is housed within said upright leg of said main body and includes an operating connection to one of said pair of valve operating levers which operating connection is reciprocable through the upper end of said upright leg.

5. A convertible spray gun as defined in claim 3 characterized in that said valve controlling the flow of pressurized air is mounted on the lower end of said upright leg.

6. A convertible spray gun as defined in claim 1 characterized in that said air flow control valve is operable independently of said liquid flow control valve.

7. A convertible spray gun as defined in claim 1 characterized in that said manually operable means is operable to provide pressurized air flow in advance of pressurized liquid flow to said spray nozzle.

8. A convertible spray gun as defined in claim 1 characterized in that said tubular coupling interconnecting said spray gun and said fogging wand accessory is adapted to be snapped on and snapped off quickly without need for tools.

9. A spray gun readily convertible between an airless operating mode and an air operating mode comprising: an elongated tubular main body having a valveless liquid spray nozzle immovably supported to discharge liquid spray from one lateral side of the upper end of said main body, said spray nozzle being exposed when said spray gun is arranged for the airless operating mode thereof, an air regulating valve at the lower end of said main body having an operating lever projecting upwardly along one side of said main body, a liquid regulating valve in said main body to control the flow of liquid to said spray nozzle including an operating lever extending crosswise of and downwardly from the upper end of said main body with its lower end overlapping with the upper end of said first mentioned lever, said two levers cooperating with said main body to form a hand grip for said spray gun, and said levers being operable when moved toward said main body to provide separate properly proportioned flows of liquid and of air for the air mode operation of said spray gun, means for deactivating the supply of pressurized air to said spray gun when used in said airless mode of operation, and a fogging accessory readily clampable about said spray nozzle and including a fog distributing wand having an outlet at the outer end portion thereof, and means for supplying pressurized air from said air regulating valve into said fogging accessory to atomize the liquid spray into a foggy mist as the liquid issues from said spray nozzle.

10. A convertible spray gun as defined in claim 9 characterized in the provision of means for discontinuing the supply of pressurized air to the liquid spray when said spray gun is operating in said airless mode with said fogging accessory removed from said spray nozzle.

11. A convertible spray gun as defined in claim 9 characterized in that each of said regulating valves is a reciprocable valve.

12. A convertible spray gun as defined in claim 11 characterized in the provision of spring means normally effective to hold each of said regulating valves closed.

13. A convertible spray gun as defined in claim 9 characterized in the provision of bayonet coupler means and seal means cooperable to hold said fogging accessory mounted about said spray nozzle in a fluid tight manner.

14. A convertible spray gun as defined in claim 9 characterized in that said levers for controlling air and liquid flow are operable to provide air flow independently of liquid flow.

15. A convertible spray gun as defined in claim 9 characterized in that levers are operable to provide air flow in advance of liquid flow to said spray nozzle.

16. A spray gun readily convertible between airless and air operating modes comprising: an elongated main body and hand grip having a pressurized liquid supply passage discharging through a valveless spray nozzle fixedly supported in the outlet end thereof which spray nozzle is exposed and accessible for servicing in said airless operating mode, quickly attachable and detachable fogging accessory means adapted to be readily telescoped over said valveless spray nozzle in a fluid-tight manner and cooperating therewith to form a fogging chamber for liquid spray discharging from said spray nozzle and including means for supplying regulatable pressurized air into the spray issuing from said spray nozzle to fog the spray, and hollow wand means for conveying said fogged liquid spray to fog discharge port means remote from said fogging chamber.

17. A convertible spray gun as defined in claim 16 characterized in that said spray nozzle is provided with a spray discharge port lying at an obtuse angle to the longitudinal axis of said main body.

18. A convertible spray gun as defined in claim 16 characterized in the provision of manually adjustable valve means for controlling the flow of pressurized liquid to said spray nozzle and including means for adjusting the position thereof in synchronism with the adjustment of said regulatable air supply means.

* * * * *